United States Patent [19]

Shoeffler et al.

[11] Patent Number: 4,708,675

[45] Date of Patent: Nov. 24, 1987

[54] STEERABLE SURFING BODY BOARD

[76] Inventors: David M. Shoeffler; Paul W. Schoeffler, both of 2 Wild Goose Ct., Newport Beach, Calif. 92663

[21] Appl. No.: 874,446

[22] Filed: Jun. 16, 1986

[51] Int. Cl.[4] ..... B63H 25/16

[52] U.S. Cl. ..... 441/65; 441/79

[58] Field of Search ..... 114/162, 163, 169, 144 R, 114/157, 159, 39.2; 441/65, 74, 79; 74/481, 480 B, 552, 557; D12/175, 176, 177

[56] References Cited

U.S. PATENT DOCUMENTS

| | | | |
|---|---|---|---|
| 809,916 | 1/1906 | Gallagher | 74/552 |
| 1,511,523 | 10/1924 | Rucker | 74/557 |
| 1,945,435 | 1/1934 | Hopkins | 441/74 |
| 2,168,961 | 8/1939 | Ragan | 74/557 |
| 2,958,875 | 11/1960 | McClain | 441/65 |
| 3,092,857 | 6/1963 | Churchman | 441/65 |
| 3,435,702 | 4/1969 | Smith | 74/557 |
| 4,285,082 | 8/1981 | Cox | 441/74 |

FOREIGN PATENT DOCUMENTS

| | | | |
|---|---|---|---|
| 97453 | 2/1924 | Fed. Rep. of Germany | 114/163 |

*Primary Examiner*—Joseph F. Peters, Jr.
*Assistant Examiner*—Edwin L. Swinehart
*Attorney, Agent, or Firm*—Timothy T. Tyson

[57] ABSTRACT

A steerable surfing body board for use by a surfer to a hydroplane down the front face of a wave. Two rudders are mounted near the front of the board and two skags are mounted at the rear. A control handle on the upper surface operates the rudders in parallel through a cogged belt between the rudder axles in the center of the board. The handle is offset 45° from the position of the rudders placing the straight ahead position of the rudders in the center of the natural arc of the hand when the elbow rests on the upper surface of the board.

3 Claims, 10 Drawing Figures

Fig. 3.
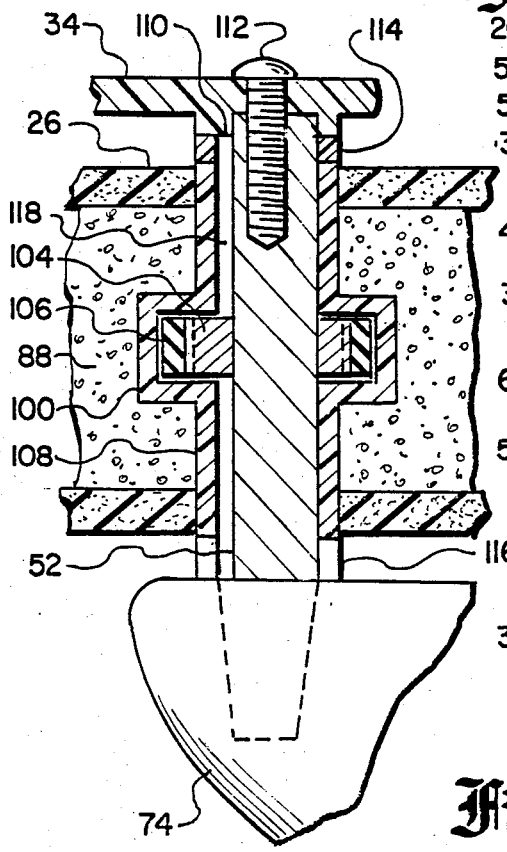
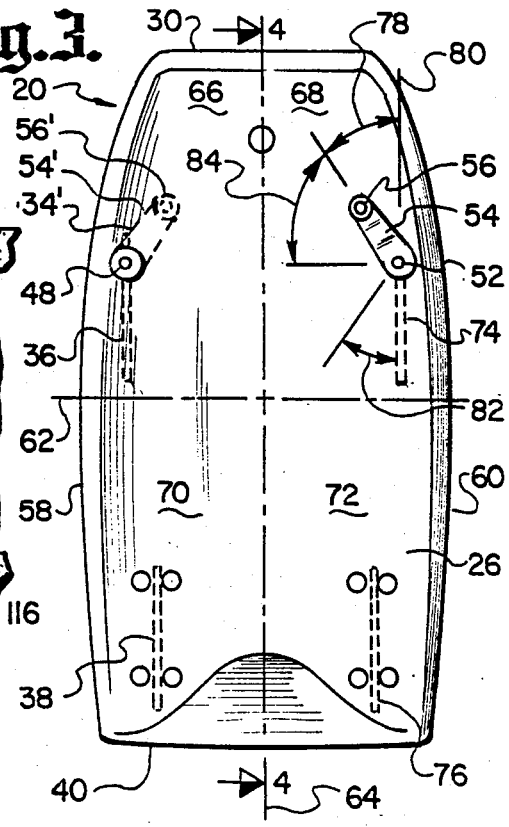
Fig. 7.
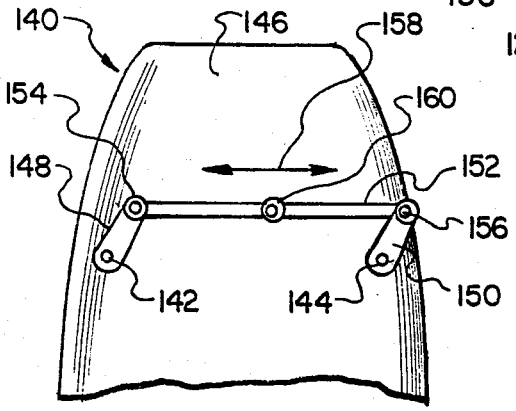
Fig. 9.
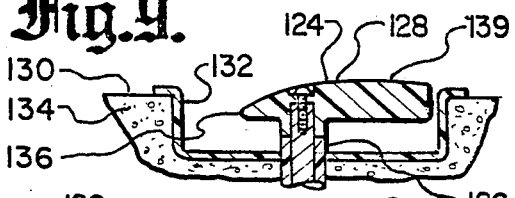
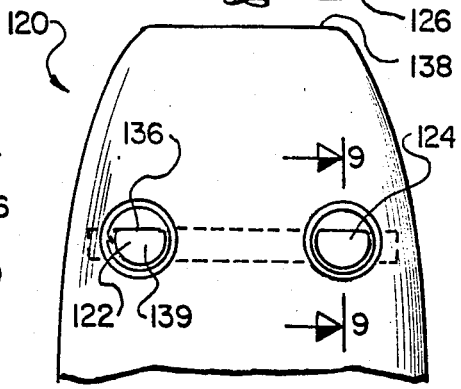
Fig. 10.
Fig. 8.

STEERABLE SURFING BODY BOARD

BACKGROUND OF THE INVENTION

1. Field of the Invention

The present invention pertains to the acquatic device art, and more particularly, to a steerable body board for surfing.

2. Background Art

Body boards and surfboards are widely used to ride the front face of a breaking wave. Body surfing is also popular where the swimmer rides the front face using only his body. The object of all these rides is to move from a floating position in the water to hydroplaning rapidly across the surface of the water using hydrodynamic forces.

Surfboards are usually of sufficient size to support the entire weight of the surfer and allow the surfer to stand on the upper surface and move around during a ride to change the direction of travel. Various types of surfboards are disclosed in U.S. Pat. Nos. 3,160,897; 3,276,050; 3,337,886; 3,747,138; 3,902,207; and 3,988,794.

Body boards are smaller and generally only support the upper part of the body out of the water in a prone position. The legs of the surfer remain in the water. A body board is disclosed in U.S. Pat. No. 4,439,165. An aid for a body surfer is disclosed in U.S. Pat. No. 4,437,842 that fits only the hand to facilitate hydroplaning across the front face of a breaking wave.

None of these self-propelled hydroplaning devices have rudders or other movable features for controlling the direction of movement during a ride. The surfboards and body boards rely primarily upon the shifting of body weight by the surfer to control the direction of travel. The body boards may also be maneuvered by the dragging of hands, arms, feet, or legs.

SUMMARY OF THE INVENTION

The present invention is directed to an improved steerable surfing body board having at least one rudder mounted on the lower surface and a control means mounted on the upper surface for controlling the rudder or rudders. Prior to a ride, the surfer lies in a prone position on the upper surface of the body board and paddles into position with his hands and feet. Swim fins are preferrably worn on the feet. During the hydroplaning ride down the front face of a wave, the surfer grasps the front of the body board with one hand in order to keep the board underneath him. The other hand is used to grasp the control means. The turning of the control means instantly affects the direction of travel. The surfer may also change the location of his body weight or drag his legs or feet to change the direction of travel. However, the use of the rudder or rudders without the use of the legs or feet substantially decreases the drag between the surfer and the water and increases the speed and maneuverability during a run.

In accordance with one important aspect of the invention, at least one skag is mounted on the lower surface of the board. The skag or skags provide a fixed point on the board during a run about which the rudder or rudders pivot the board when turned. Sharper turns are thereby made possible with less sideways skidding.

In a preferred embodiment, two rudders and two skags are positioned on the lower surface. One of the rudders is positioned in the front right quadrant and the other in the front left quadrant. The rudders are mounted longitudinally adjacent the middle of the front quadrants and laterally adjacent the right and left lateral sides. One of the skags is positioned in the rear right quadrant and the other in the rear left quadrant. The result is effective control of all four active corners of the board. The board in front of the rudders tends to be less than an optimal control surface due to being lifted away from the water by the combined action of the hand holding the front of the board and the majority of the weight of the surfer at the rear of the board. The placement of the rudders in the front and the skags in the rear takes further account of the overall balance of the board in use. The front carries relatively little weight during a run and is therefore relatively easy to maneuver. The rear, on the other hand, carries most of the weight and therefore serves as a natural pivot. The turning of the rudders in the preferred embodiment instantly rotates the front of the board around the skags and the rear of the board. The two rudders positioned outboard near the front also serve to provide control of the board at all times. During a run, the surfer angles the board down the face of the wave. The curl of the wave throws the lower rudder deep into the water and tends to lift the upper rudder out of the water. Most or all of the control is therefore provided by the lower rudder. The positioning of the rudders toward the lateral sides enhances this control. When the surfer changes the direction of travel, the relative position of the rudders is reversed.

In accordance with one important aspect of the invention, the control means has a single control handle for controlling both of the rudders. The rudders are thereby maintained permanently parallel to each other. Thus, when a reversal of direction of travel takes place, the previously non-controlling rudder is properly positioned to instantly take control from the previously controlling rudder.

In a preferred embodiment, the two rudders are mounted on axles passing into the body board perpendicular to the lower surface and parallel to each other. A cogged pulley is positioned on each of the axles between the upper and lower surfaces. A cogged belt connects the two pulleys. The connection thereby provided between the two rudders is out of the environment, water resistent, and maintains the relative positions of the rudders to each other.

In accordance with one important aspect of the invention, the control means has a single control handle mounted on an axle perpendicular to the upper surface and having an upper end adjacent the upper surface. The handle has a crank arm mounted on the upper end of the axle. A hand grip portion is mounted on the crank arm perpendicular to the upper side of the arm and parallel to the axle. The surfer is thereby able to hold and move the hand grip portion with his hand while resting his elbow on the upper surface of the board.

In a preferred embodiment, the crank arm is mounted on the axle 45° to the left or right of the position for the rudders depending upon which hand is used to hold the hand grip portion. When the right hand is to be used, the crank arm is to the left of the axle and the surfer holds the grip with his upper arm in line with the axle. The surfer is thereby able to rotate the rudders through 90° while rotating his hand about his wrist only 45° in either direction without moving his arm from alignment with the axle thereby optimizing the strength and dexterity of his hand and arm. If the left hand is to be used, the crank arm is positioned 45° to the right of the position of the rudders.

BRIEF DESCRIPTION OF THE DRAWINGS

FIG. 3 is a top plan view of the body board with the bottom features in shadow outline;

FIG. 7 is an enlarged sectional view along the line 7—7 of FIG. 6;

FIG. 8 is a top plan view of the front portion of another embodiment;

FIG. 9 is a sectional view along the line 9—9 of FIG. 8; and

FIG. 10 is a top plan view of the front portion of another embodiment.

DESCRIPTION OF THE PREFERRED EMBODIMENTS

Figure 1:
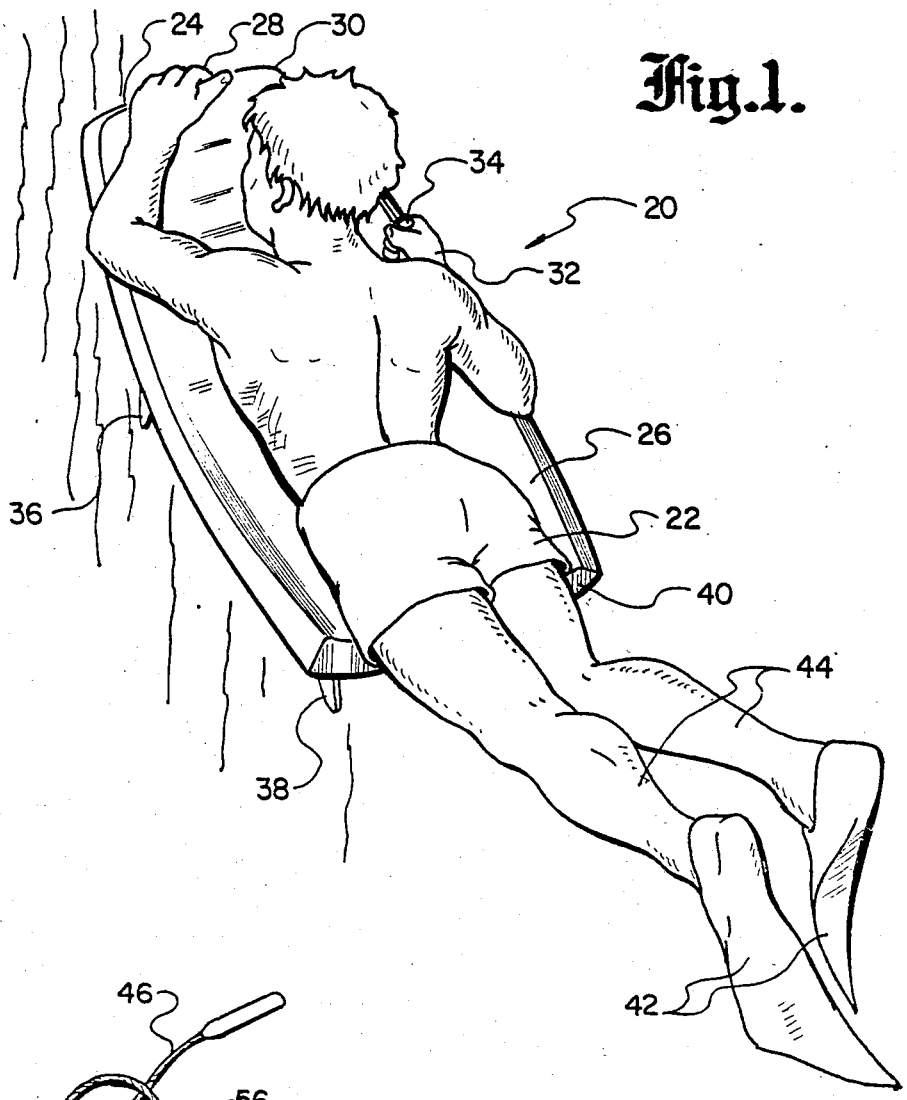
FIG. 1 is perspective view of a steerable surfing body board of the present invention being used by a surfer.

Referring initially to FIG. 1, there is illustrated a perspective view of a steerable surfing body board, generally designated 20, of the present invention being used by a surfer 22 to hydroplane down the front face 24 of a wave. The surfer 22 lies in a prone position on the upper surface 26 of the board 20 with his left hand 28 holding onto the front 30. His right hand 32 grips a control handle 34 that provides a means of control for a left rudder 36 under the board 20 allowing him to turn as desired without dragging his hands, arms, feet, legs in the water as is often practiced with conventional body boards. A left skag 38 keeps the rear 40 of the board 20 tracking after the front 30 and minimizes sideways slippage by the rear 40. The surfer 22 has swim fins 42 on his feet in order to facilitate his initial positioning in the water prior to the arrival of a wave and to allow him to kick strongly and catch the front face 24 when it arrives. As shown in FIG. 1, he has lifted his legs 44 and the fins 42 entirely out of the water in order to minimize drag, maximize foward velocity, and permit faster turns.

Figure 2:
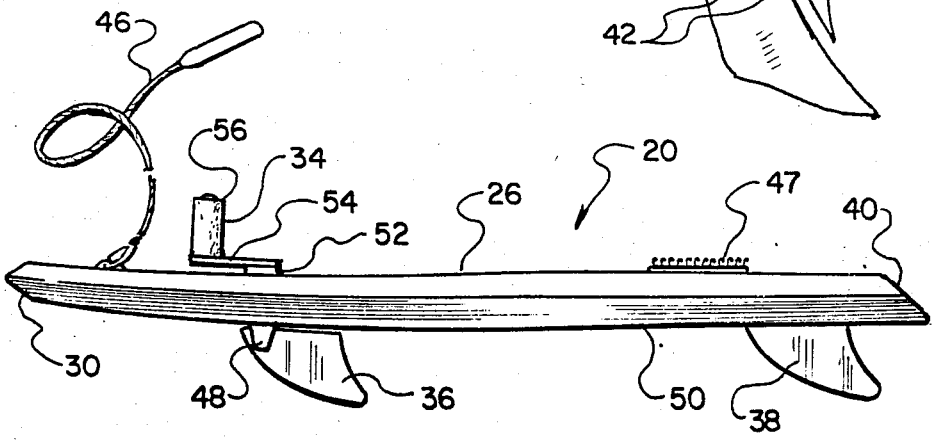
FIG. 2 is a left side elevational view of the body board of FIG. 1.

FIG. 2 is a left side elevational view of the body board 20 of FIG. 1 with an ankle strap 46 for securing the board 20 to the surfer 22 in case of a wipe out where the surfer looses his hold on the board. A hook and loop fastener portion 47 such as sold under the trademark Velcro is also provided on the upper surface 26 for coupling with a hook and loop fastener portion attached to the surfer's swimming or wet suit for aiding in retaining the surfer on the body board 20 during radical maneuvers.

The left rudder 36 is mounted on a left axle 48 and rotates about the axle. The left axle 48 is mounted in the board 20 perpendicular to the lower surface 50. The control handle 34 provides a means for controlling the left rudder 36 and rotates on a separate right axle 52 on the right side of the board as shown below in FIG. 3. The right axle 52 is perpendicular to the upper surface 26. The handle 34 has a crank arm 54 that is mounted on the right axle 52 and a hand grip portion 56 perpendicular to the upper side of the crank arm and parallel to the right axle 52. The configuration of the control handle 34 allows the surfer to hold and rotate the handle while maintaining his elbow on the upper surface 26 of the board if desired. As shown in FIG. 2, the hand grip portion 56 is cylindrical with an outer covering of foam. Other forms of hand grips may be provided including spherical or contoured. The left skag 38 is rigidly attached to the lower surface 50 and keeps the rear 40 of the board tracking after the front 30.

FIG. 3 is a top plan view of the body board 20 with the bottom features shown in shadow outlines. The front 30, rear 40, left lateral side 58, and right lateral side 60 define the outer shape of the board. The board 20 may be divided along the lines 62 and 64 into a front left quadrant 66, a front right quadrant 68, a rear left quadrant 70, and a rear right quadrant 72. The left rudder 36 is positioned in the front left quadrant 66 on the left axle 48. The axle 48 is located approximately in the middle of the quadrant 66 longitudinally and adjacent the left lateral side 58 laterally. The right rudder 74 is positioned in the front right quadrant 68 on the right axle 52. The axle 52 is located approximately in the middle of the quadrant longitudinally and adjacent the right lateral side 60 laterally. The left skag 38 is positioned in the rear left quadrant 70 adjacent the rear 40 and the right skag 76 is positioned in the rear right quadrant 72 also adjacent the rear 40.

The relative placement of the rudders 36 and 74 to the board 20 and to the skags 38 and 76 provides optimal effective control of all four active corners of the board. The placement of the rudders 36 and 74 toward the front 30 and the skags 38 and 76 at the rear 40 takes account of the overall balance of the board 20 during use. The front half (quadrants 66 and 68) carries relatively little weight during a run and is therefore easy to maneuver. The rear half (quadrants 70 and 72) carries most of the weight and therefore serves as a natural pivot. However, the rudders 36 and 74 are not placed exactly at the front 30 because the front is often out of the water. The front 30 is bent slightly upward to form a bow as shown in FIG. 2. The front 30 is also lifted away from the water continuously by the combined action of the surfer holding and lifting the front 30 and the location of the majority of the weight toward the rear rotating the rear downward and the front upward. Therefore, in order to assure contact of the rudders 36 and 74 with the water most of the time, the rudders 36 and 74 are located half way down the front quadrants 66 and 68.

During a run as shown in FIG. 1, the surfer 22 angles the board 20 down the face 24 of the wave. The curl of the wave throws the lower rudder deep into the water and tends to lift the upper rudder out of the water (right rudder 74 and left rudder 36, respectively). Most or all of the control is therefore provided by the lower rudder. The positioning of the rudders 36 and 74 toward the lateral sides 58 and 60 enhances this control. When the surfer 22 reverses the direction of travel down the face 24 of the wave toward the viewer, the relative positions of the rudders is reversed. The left rudder 36 becomes the effective control rudder and the right rudder 74 may be lifted out of the water.

As shown in FIG. 3, the control handle 34 is positioned on the right axle 52 with the crank arm 54 moved approximately 45° to the left of the direction of the right rudder 74 as indicated by the arrows 78 placing the hand grip portion 56 out of alignment with the rudder indicated by the line 80. When the surfer lies on the board 20 and uses his right hand, he holds the hand grip portion 56 with his upper right arm substantially in alignment with the rudder 74 in the straight ahead position. In this position, the right hand is bent 45° from the line of the upper right arm matching the angle of the crank arm 54 to the rudder 74. Movement of the hand 32 to the right 45° into alignment with the upper right arm swings the rudder 74 to the left 45° as represented by the arrows 82 turning the board 20 toward the right. Movement of the hand 32 to the left 45° as indicated by the arrows 84 turns the board 20 toward the left.

The purpose of placing the crank arm 54 at a 45° angle to the rudder 74 and of having the hand grip portion 56 perpendicular to the upper surface of the crank arm 54 is to utilize the natural strengths of the hand, wrist, and arm. When the elbow is placed on the upper surface 26 of the board 20 with the upper arm in alignment with the rudder 74 and the wrist turned allowing the hand 32 to hold the hand grip portion 56, the hand easily moves through an arc of approximately 90° from slightly right of alignment with the upper arm to approximately perpendicular to the lower surface of the upper arm. Any movement greater than this natural range requires the elbow to be lifted and moved. By placing the straight ahead position of the rudder 74 in the middle of the swing range of the hand 32, maximium maneuverability of the board 20 to the left and right is afforded without requiring the elbow or upper arm to be moved or lifted.

Alternately, when the surfer uses his left hand, a left control handle 34' (represented in shadow outline) is positioned on the left axle 48. The right control handle 34 may then be removed, if desired, or left on the board 20 to allow the surfer to alternate between the control handles 34 and 34' as his body position or the nature of the ride changes. The left control handle 34' has a crank arm 54' positioned on the left axle 48 approximately 45° to the right of the straight ahead position for the left rudder 36. When the left handed user holds the hand grip portion 56' with his upper left arm in alignment with the left rudder 36 in the straight ahead position, the full swing range of the left hand to the left and right is afforded in the same manner as the use of the right hand on the right control handle 34.

Figure 4:
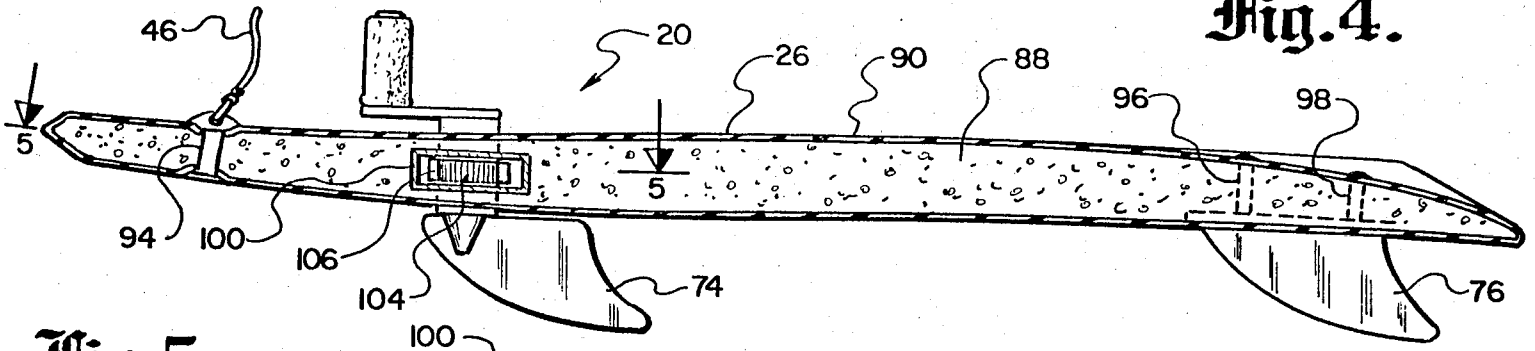
FIG. 4 is a sectional view along the line 4—4 of FIG. 3.

FIG. 4 is a sectional view along the line 4—4 of FIG. 3. The body board 20 has a foam core 88 to provide flotation and slick skins 90 and 92 on the upper surface 26 and the lower surface 50, respectively, to minimize the friction between the board and the water. The ankle strap 46 and the right skag 76 are coupled to the board 20 by fasteners 94, 96, and 98. The right axle 52 passes entirely through the board and serves as the axle for both the control handle 34 and the right rudder 74.

Figure 5:
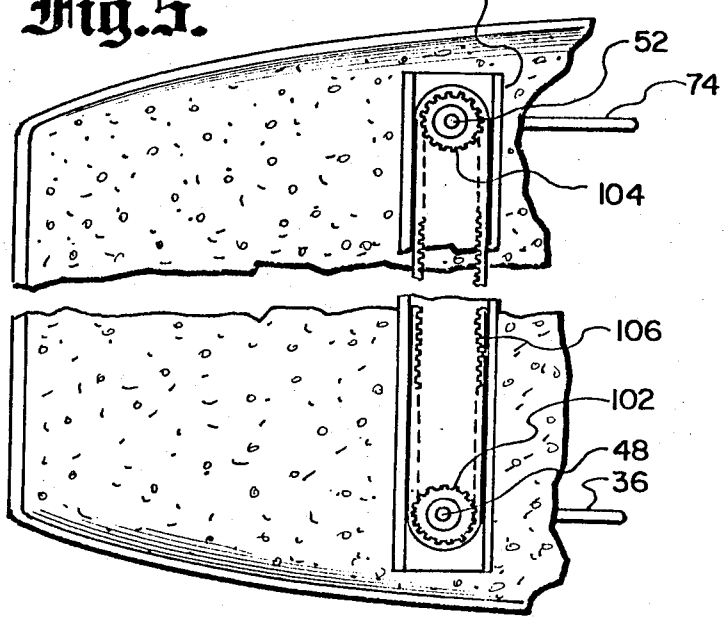
FIG. 5 is a partial sectional view along the line 5—5 of FIG. 4.

FIG. 5 is a partial sectional view along the line 5—5 of FIG. 4. As show in both FIGS. 4 and 5, a box 100 is located inside the foam core 88 passing between the right and left axles 52 and 48. Included as part of the control means for controlling the rudders 36 and 74 are cogged pulley 102 and 104 fitted to the right and left axles 52 and 48. A cogged belt 106 is positioned around the pulleys 102 and 104 to rotate the left axle 48 in unison with the right axle 52 and, therefore, the left rudder 36 in unison with the right rudder 74 when the right control handle 34 is moved. Alternately, when the left control handle 34' is used (FIG. 3), the right rudder 74 is moved in unison with the left rudder 36 when the left control handle 34' is moved. The rudders 36 and 74 are thereby maintained permanently parallel to each other no matter what direction the rudders are turned. As noted above, the down side rudder primarily serves as the controlling rudder while the up side rudder may be partially or totally out of the water. When the surfer turns the board and makes a reversal of direction, the previously non-controlling rudder is properly positioned by the cogged belt 106 and the pulleys 102 and 104 to instantly take control from the previously controlling rudder.

Figure 6:
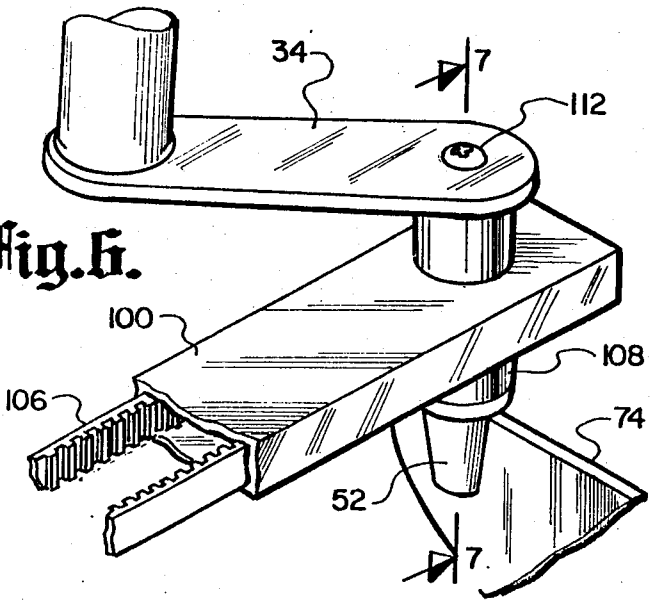
FIG. 6 is a perspective view of a portion of the control means and a rudder.

FIG. 6 is a perspective view of a portion of the control means and the right rudder 74. FIG. 7 is an enlarged sectional view along the line 7—7 of FIG. 6. FIGS. 6 and 7 together show details of the construction of the control means and rudder 74. The rudder 74 is coupled to the right axle 52 that rotates inside a cylindrical housing 108. The housing is an extension of the box 100 inside the foam core 88. The axle 52 has an upper end 110 adjacent the upper surface 26 of the board. The control hand 34 is retained on the upper end 110 by a screw 112. Upper and lower bushings 114 and 116 allow the handle, axle, and rudder assembly to rotate freely in the cylindrical housing 108. The cogged pulley 104 is fitted to the axle 52 in the center and carries the cogged belt 106. A key 118 keeps the various elements from rotating in relation to each other.

FIG. 8 is a top plan view of the front portion of another embodiment, generally designated 120, of the present invention. The body board 120 is identical to the body board 20 except for the substitution of left and right cupped control wheels 122 and 124, respectively, for the left and right control handles 34' and 34 shown in FIG. 3. FIG. 9 is a sectional view along the line 9—9 of FIG. 8. The right cupped control wheel 124 is mounted on a right axle 126 positioning the top surface 128 of the wheel approximately at the upper surface 130 of the body board 120. The wheel 124 rotates in a cup 132 set into the foam core 134 of the body board 120. A finger grip portion 136 is provided in the wheel 124 in front of the axle 126 toward the front 138 of the board 120 when the rudders under the board are in a straight ahead position. The wheel 124 also has a palm rest portion 139 opposite the finger grip portion 136 across the axle 126. The cupped control wheel 124 is utilized by placing the palm of the hand onto the palm rest portion 139 and curling the fingers around the finger grip portion 136 down into the cup 132. The hand is then rotated to the right or left to steer the body board 120 in the desired direction.

FIG. 10 is a top plan view of the front portion of another embodiment, generally designated 140, of the present invention. The body board 140 is similar to the previous embodiments with respect to the overall shape and position of the rudders and skags. However, the control means is substantially modified. Left and right axles 142 and 144, respectively, pass entirely through the body board 140 perpendicular to the lower surface and the upper surface 146 and parallel to each other. A left rudder is coupled to the left axle 142 and a right rudder is coupled to the right axle 144 in the same manner as the rudders in the previous embodiments. Left and right crank arms 148 and 150, respectively, are attached to the tops of the axles 142 and 144. A tie rod 152 is rotatably coupled to the left crank arm 148 at a left tie rod axle 154. The other end of the tie rod 152 is rotatably coupled to the right crank arm 150 at a right tie rod axle 156. When the tie rod 152 is moved to the right or left as indicated by the arrows 158 either by using a handle 160 or holding the tie rod directly, both of the rudders underneath the body board 140 are moved in parallel in the same manner as in the previous embodiments.

In view of the above, it may be seen that a steerable surfing body board is provided that significantly improves the ability of a surfer to control a body board. Of course, the structure may be variously implemented and variously used depending upon specific applications. Accordingly, the scope hereof shall not be referenced to the disclosed embodiments, but on the contrary, shall be determined in accordance with the claims as set forth below.

We claim:

1. A steerable hydroplaning body board, comprising:

a body board having upper and lower surfaces and adapted to supporting a user on said upper surface;

two rudders mounted on said lower surface;

two skags mounted on said lower surface; and a control means mounted on said upper surface controlling said two rudders having:

a single control handle for controlling both of said two rudders and maintaining said two rudders substantially parallel to each other;

a separate axle for each of said two rubbers passing into said body board substantially perpendicular to said lower surface and parallel to each other;

a pulley on each of said separate axles between said upper and lower surfaces; and a belt between said pulleys.

2. The body board according to claim 1 wherein said pulleys are cogged pulleys and said belt is a cogged belt.

3. A steerable hydroplaning body board, comprising:

a body board having upper and lower surfaces and adapted to supporting a user on said upper surface;

two rudders mounted on said lower surface;

two skags mounted on said lower surface; and a control means mounted on said upper surface controlling said two rudders having:

a single control handle for controlling both of said two rudders and maintaining said two rudders substantially parallel to each other;

two axles passing through said body board substantially perpendicular to said lower and upper surfaces and parallel to each other;

one of said two rudders coupled to one of said two axles and the other of said two rudders coupled to the other of said two axles;

two crank arms, one coupled to one of said two axles and the other coupled to the other of said two axles; and a tie rod coupled between said two crank arms.

* * * * *